United States Patent [19]

Laciny

[11] Patent Number: 4,737,106

[45] Date of Patent: Apr. 12, 1988

[54] WEAPON TRAINING SYSTEMS

[75] Inventor: Richard W. Laciny, London, England

[73] Assignee: Schlumberger Electronics (U.K.) Limited, Farnborough, England

[21] Appl. No.: 842,649

[22] Filed: Mar. 21, 1986

[30] Foreign Application Priority Data

Mar. 23, 1985 [GB] United Kingdom ..... 8507588

[51] Int. Cl.[4] ..... F41C 27/00

[52] U.S. Cl. ..... 434/22; 434/21

[58] Field of Search ..... 434/22, 21

[56] References Cited

U.S. PATENT DOCUMENTS 3,832,791 9/1974 Robertsson ..... 434/22

4,063,368 12/1977 McFarland et al. ..... 434/22

*Primary Examiner*—Leo P. Picard

*Attorney, Agent, or Firm*—Dale Gaudier

[57] ABSTRACT

In a weapons training simulator, laser radiation is output via optics (28) to simulate the firing of a round, and reflected radiation received via a conjugate path to assess the effectiveness of the shot. In the event of a miss a scan of the target area is required to provide fall of shot information. The scan is performed by controlled movement of the output faces of fibre optics (23, 24, 25) flexibly coupling to fixed sources (20, 21, 22) and of the input face of a fibre optic (200) flexibly coupling to a fixed detector (201). The problem of the bulk and inertia of prior art systems is improved by the remote location of lasers, drive and control, which may be conveniently separated for service or replacement without disturbing the optically aligned input and output faces. A further improvement is that vertically aligned multiple sources may be employed without undue weight penalty, yielding elevation information from a lateral scan.

12 Claims, 6 Drawing Sheets

WEAPON TRAINING SYSTEMS

This invention relates to weapon training systems and in particular to the simulation of direct fire weapons.

Weapon training systems for training weapon operators in aiming and firing procedures without the expense and danger of firing live ammunition are well known and are described in British Patent Specifications Nos. 1 228 143, 1 228 144 and 1 451 192. In these systems, a weapon is typically sighted on a target, and a source of electromagnetic radiation, such as a laser, contained in the training system and aligned with the weapon, is used to determine the range of the target. Thereafter, the weapon is aimed by offsetting it in elevation and azimuth, to take account of the range (and motion, if any) of the target. When the weapon is 'fired', the laser beam is offset in the opposite sense by the correct amounts for a target having the measured range and motion, so that, if the weapon has been correctly aimed, the offsets applied to the weapon are exactly compensated and the ultimate orientation of the laser beam (the beam datum direction) corresponds to the direction to the target. Energisation of the laser can then be detected at the target to indicate a hit, the information being conveyed back to the weapon site for example by radio. Alternatively a detector at the weapon site may receive radiation reflected by a reflector at the target, as for example described in British Patent Specification No. 1 439 612.

A particularly attractive feature of such systems is the ability to provide the operator with fall of shot information in the event of a miss. In order to provide this information the radiation source is scanned to locate the actual position of the target so that the miss-distance may be computed. Scanning is achieved by mounting a radiation source on a controllably moveable platform as described for example in British Patent Specification No. 2 030 272 B. The source may be scanned firstly in azimuth until the target is located and then in elevation to establish a second co-ordinate; the position of the target may then be finally established by ranging. Although it is known to use separate sources to scan in azimuth and elevation, essentially detection is by a single source. In laser based systems if they are to be eye-safe, an upper limit is imposed on the power source and thereby a maximum useful range. A typical maximum range is less than that desirable to be able to fully simulate the performance of current artillery.

Since scanning is performed mechanically, scanning rate is limited by such factors as inertia of moveable table, radiation source and associated optics, ruggedness of the source, etc. Hence scanning is relatively slow even for a reasonably well aimed weapon. Solid state scanning, based on assessing returns from an array of several sources has been proposed in an attempt to improve scan rate. Unfortunately such systems are only able to scan within a relatively narrow aperture if the output array is to be of practical size and number. Since it is desirable that simulation systems provide details of even a bad miss this arrangement itself must be mechanically scanned.

According to the present invention a weapons training simulator includes:

source means for producing electromagnetic radiation, output means for forming said radiation into a directable beam, input means for receiving reflected radiation and detector means for sensing received radiation intensity;

wherein the output means and the input means are moveable on the weapon to achieve a scan of a target area, and the source means and the detector means are fixed on the weapon; and further includes flexible guidance means for conveying radiation from the source means to the output means and the input means to the detector.

Preferably the flexible guidance is provided by fibre optics. Advantageously, a plurality of sources and fibres provides spaced apart beams, complete coverage of the target area being established by virtue of the scan. The input means may include a receptor fibre of larger optical diameter than the output fibres. In a preferred embodiment of the present invention three laser sources having fibres sharing common input means are employed.

Preferably the scan is established by moving the output beams with respect to the weapon firstly in azimuth to establish a first scan line, then in elevation a distance less than one beam width, and thirdly in reverse azimuth to establish a second scan line so that complete coverage is achieved. A cumulative positional average of received radiation intensity may be computed to establish target position in azimuth as the scan proceeds. Preferably a single source is active at any one time, the sources being activated for example sequentially. A cumulative positional average of returns during each scan line may be computed to yield some elevation information on target position. Greater resolution in elevation may be achieved by a further elevation scan with for example a single source activated.

In order that features and advantages of the present invention may be appreciated an embodiment will now be described by way of example only and with reference to the accompanying diagrammatic drawings, of which:

Figure 1:
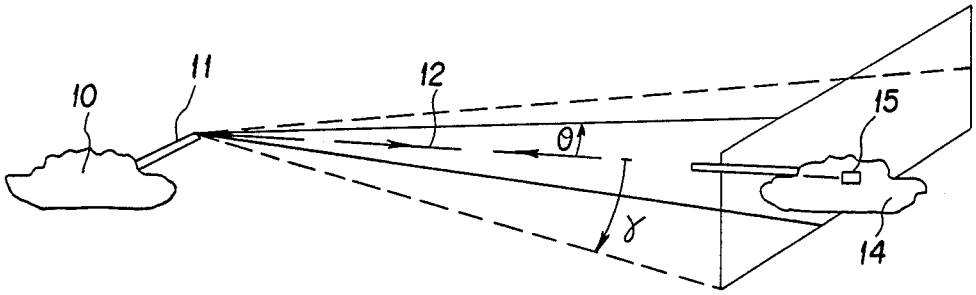
FIG. 1 represents a typical prior art weapon simulation.

In a simulated attack in accordance with the prior art by a tank 10 (FIG. 1) on a target 14 electromagnetic radiation is launched from a weapons simulator located in attacker gun barrel 11 as a directable beam along a path 12 and some of the radiation returns via substantially the same path by virtue of a reflector 15 on the target 14. The beam 12 is launched in a direction such that it passes through the point of impact of a simulated round at an operator selected range determined by gun barrel elevation. In the event that the beam 12 does not strike the target, the beam is scanned firstly in azimuth $\gamma$ and secondly elevation $\theta$ to locate the target so that miss-distance may be computed. The exact operation of such a system will become apparent to those studying the documents hereinbefore referenced.

In a weapons simulator in accordance with the present invention sources of electromagnetic radiation are provided by laser diodes 20, 21, 22. Light from the diodes is conveyed by fibre optics 23, 24, 25 respectively to be launched at beam splitter 26 which provides a directable beam 27 by virtue of lens 28. Returning light enters the lens 28 and follows a conjugate path to the beam splitter 26, where returning incident light is reflected towards a folding reflector 29, which serves to direct the light at an input face of a fibre optic 200. The fibre optic conveys incoming light to an avalanche diode detector 201. The nature of the lens 28, splitter 26 and reflector 29 will be apparent to those skilled in optics, and will not be further described here. These components are mounted on a tiltable and panable table 202 so that the beam may be steered in elevation and azimuth by activating motors 203 and 204 respectively. Laser sources 20–22 and detector 201 are mounted away from the table 202, being fixed on the weapon. Pan and tilt movement of the table 202 is accomodated by flexure of fibre optic light guides 23–25 and 200.

The layout of the light guides and operation of the embodiment described above will now be considered in more detail.

Optical fibres 23, 24 and 25 are arranged such that their output faces are precisely vertically aligned (FIG. 3, which essentially represents a view from direction Z of FIG. 2) and spaced apart. The spacing S is arranged to be less than the fibre output face diameter d. The optical relationship between these output fibres and the input fibre 200 is such that reflected light may be received from any output fibre, the input fibre 200 being larger in diamter than the output fibres to allow both for the spacing and any dispersion during transit. It will be appreciated that physically the fibres are separate by virtue of the beam splitter and the folding reflector 29.

Figure 4:
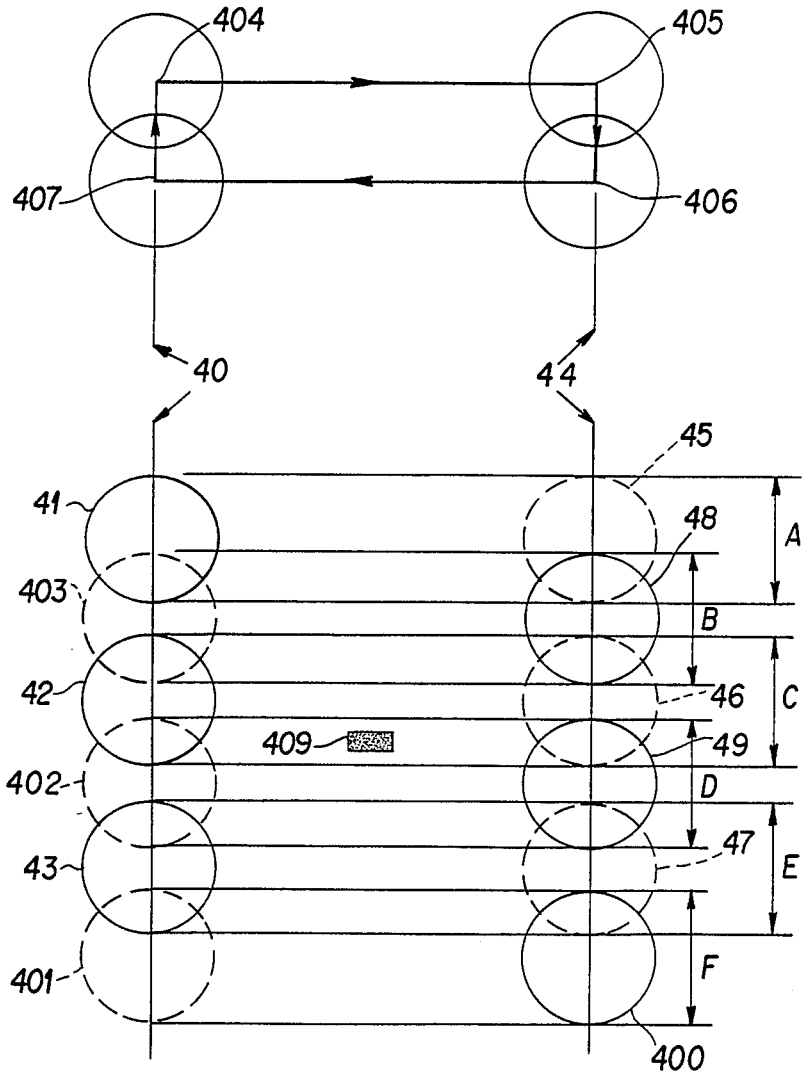
FIG. 4 shows a scanning pattern, FIG. 4(*a*) shows resulting response histograms.
Figure 4:
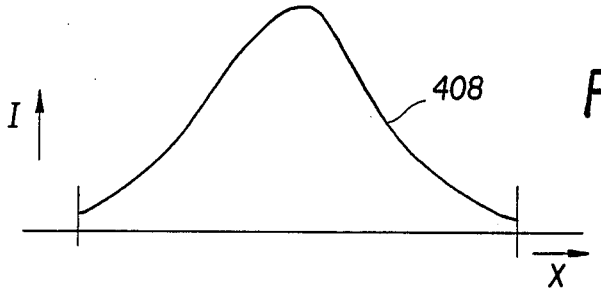
Figure 4A:
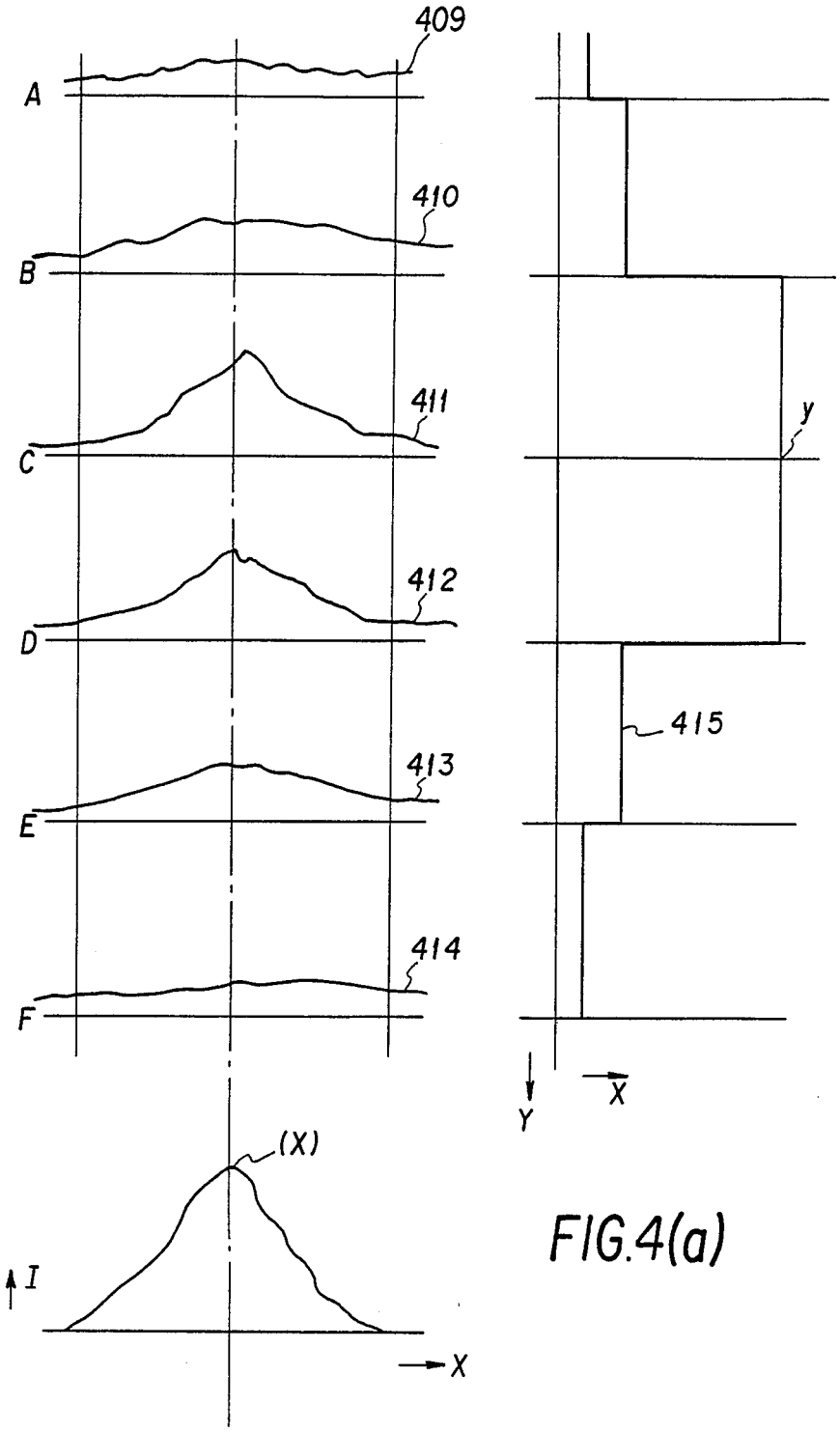

In operation it is required to scan an area to locate the target. At the start of the scan it is arranged that the vertically aligned fibres are at an extreme of azimuth 40 (FIG. 4) as indicated by positions 41, 42, 43. The general form of the scan is to traverse the area in azimuth to other extreme 44, (positions 45, 46, 47) then to tilt in elevation (positions 48, 49, 400) to scan the thus far uncovered region as the assembly returns to azimuth extreme 40, (positions 401, 402, 403). The general scheme of the scan of a single output fibre is shown in the figure detail, the scan being in azimuth from position 404 to 405, depress in elevation to position 406, return in azimuth to position 407, and return in elevation to position 404. It will be apparent that by virtue of the geometry and fibre spacing this simple scanning pattern results in complete coverage of the area to be scanned. The scan may be considered to occur along six overlapping scan lines (A, B, C, D, E and F). As the scan progresses in azimuth a histogram 408 representing the position related average intensity (I) of returns may be built up. The histogram contains azimuth information only, being effectively the sum of returns from all three sources over both the go and return passes shown for convenience as abscissa x. The example histogram 408 would be that expected for a target 409 located in the centre of the scanned area. The sources 20, 21, 22 are not continuously energized, only one emitting at a time. The sources are sequentially energized at a rate high in comparison with the rate of scan, thus maintaining essentially complete coverage in azimuth. Since the sources are individually energized and the elevation and azimuth is controlled histograms 409, 410, 411, 412, 413, and 414 of returns due to each scan line A, B, C, D, E, F individually may be built up. Since the scan lines are spaced apart in elevation, some elevation positional information may be extracted from the histograms. Example histograms 409–414 are again those due to a central target 46. By plotting the average Intensity value of each scan line against scan line position shown for convenience as ordinate y, a histogram 415 indicating target elevation may be built up. It will be appreciated that even with this simple signal processing the azimuth (x) and elevation (y) of the target can be extracted in a single scan cycle.

It will be realized that resolution in azimuth is theoretically unlimited, and in practice will be limited by radiation frequency/bandwidth, aberration etc. In elevation, resolution is to at least one scan line and is sufficient for some simulation purposes. If greater resolution in elevation is required a full elevation scan at the known azimuth using a single source only may be performed. Alternatively a curtailed scan centred on the known approximate elevation may be used to more accurately locate the target. System control and signal processing will now be described in more detail.

Figure 5:
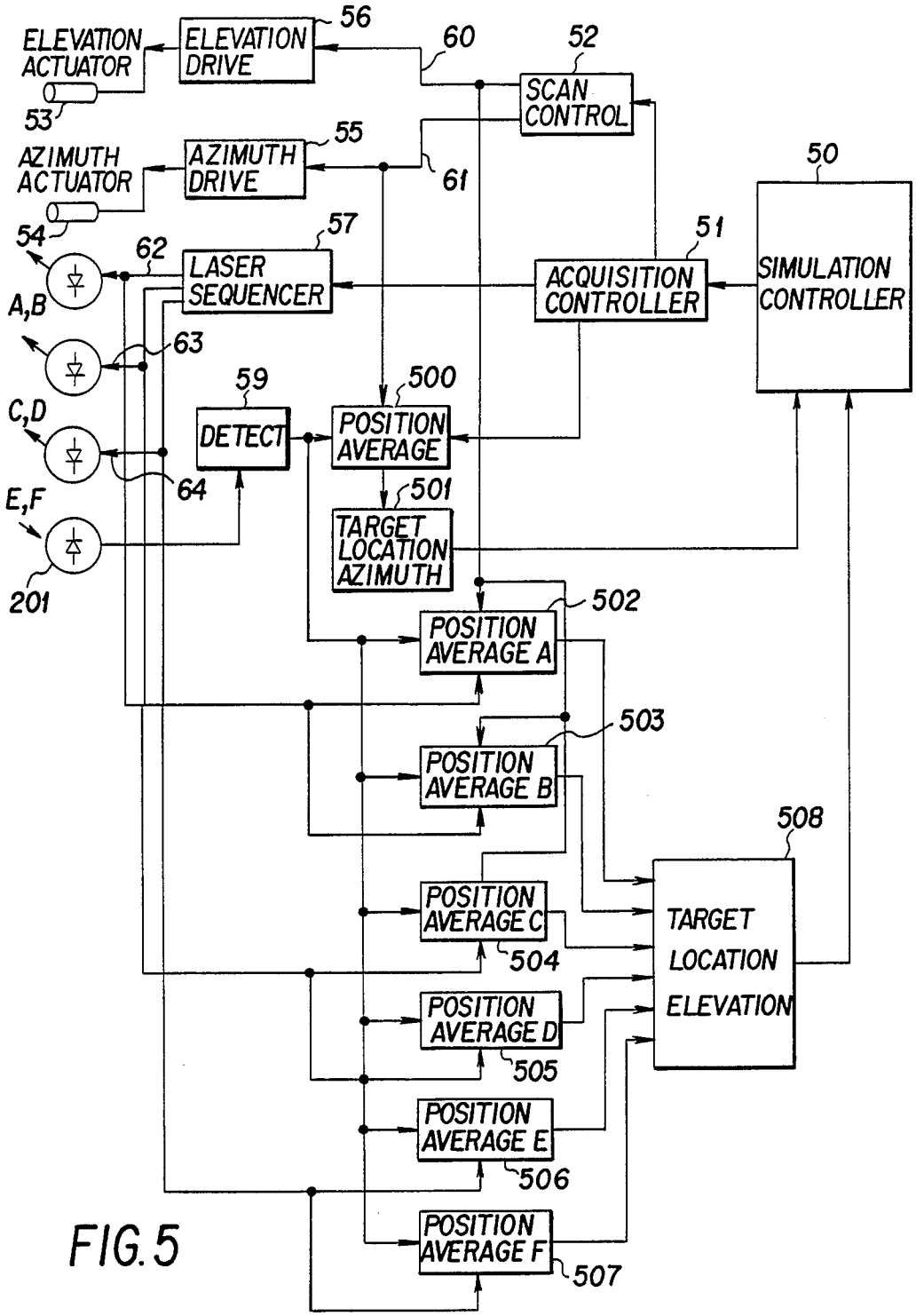
FIG. 5 shows weapons simulation apparatus.
Figure 6:
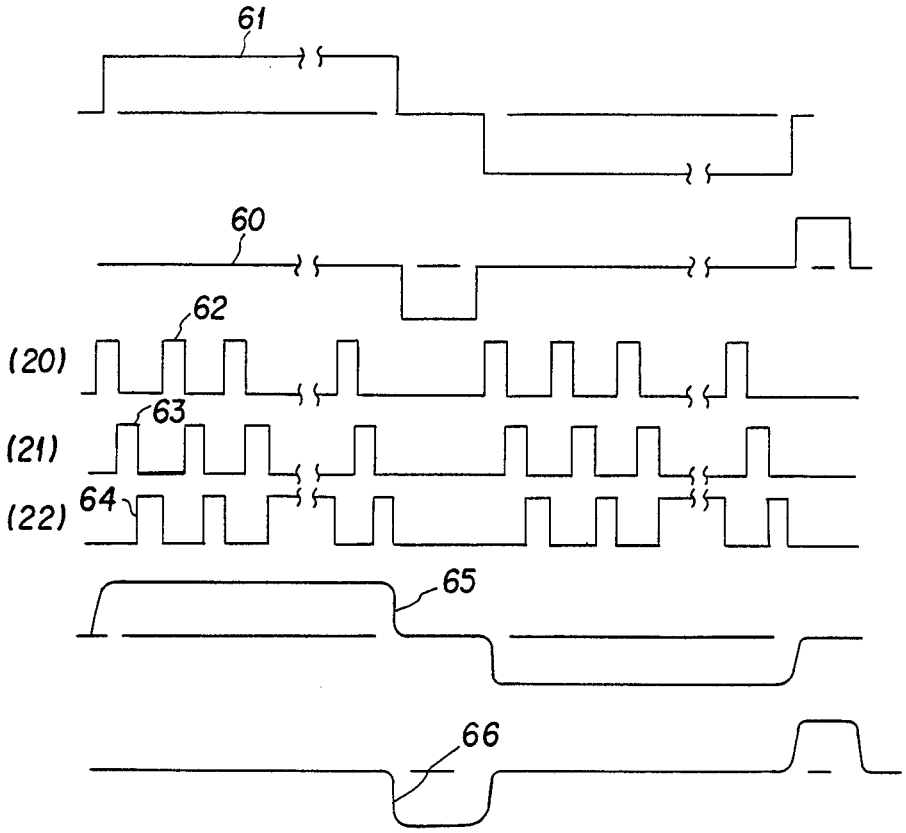
FIG. 6 is illustrative of the operation of the apparatus of FIG. 5.

As part of a weapons effect simulation a simulation controller 50 (FIG. 5) signals acquisition controller 51 that the position of a target is to be acquired. Controller 51 indicates an acquisition sequence by signalling scan controller 52 to move actuators 53, 54 controlling a table, such as table 202 of FIG. 2, such that the table is at an extreme of azimuth and elevation and therefore ready to commence a scan of a target aperture. Scan controller provides signals 60, 61, the form of which is shown in FIG. 6 to drive the table in azimuth via azimuth drive 55 and actuator 54 and elevation drive 56 and actuator 53 respectively. It will be apparent from signals 60 and 61 that the table is driven to scan firstly in azimuth, then to depress in elevation, and finally to scan again in azimuth at the new elevation before returning to the original starting position by raising in elevation: it will be appreciated that the scanning pattern previously described is thereby achieved. During the scan acquisition controller 51 signals laser sequencer 57 to generate waveforms 62, 63, 64 which respectively energize lasers 20, 21 and 22.

During the scan, signal returns if any are received via avalanche diode detector 201 and detector discriminator 59. In response to returns signal from detector discriminator 59 and azimuth position information from scan control 52 a position average 500 is built up as hereinbefore described to give target location in azimuth 501 which may be returned to the simulation controller 50 for further processing. The positional average is made up of returns from all lasers in both scan directions.

In elevation separate positional averages 502, 503, 504, 505, 506 and 507 are built up for returns from each scan line. Elevation information is derived from scan controller 52. As previously described positional averages 502–507 may be interpreted to provide a coarse target location in elevation 508. If more accuracy in elevation is required, then an additional elevation scan may be performed using a single laser in a way similar to the azimuth scan already described.

From the foregoing description a number of important features of the present invention will be apparent. Firstly since the lasers are fired only periodically, the powere rating of each individual laser may be greater than the limit for continuous eye-safe operation, whilst still providing safety. Thus the invention permits longer range operation. The range is infact sufficient to permit safe simulation of laser based sights. The mechanical nature of the scan allows a large aperture to be covered, however since vibration sensitive and bulky laser components are not mounted on the scanning table, the rate of scan may be maximized. Traces 65 and 66 show typical responses in azimuth and elevation to control signals 61 and 60 respectively. These responses show that the table may be accelerated into and braked out of the scan so that scan rate is substantially constant at a high rate. The acceleration limits and constraints of the prior art are thereby removed, since only the fibres output faces are scanned, not the lasers themselves. Thus the raster scan of the present invention is made possible, to replace the ponderous target dependent scan of the prior art necessitated by the bulk of the tilting platform. It will be realized that in this arrangement, the fibre optics do not act as diffusers, but form part of the optically accurate configuration.

A further advantage of the scanning pattern proposed is that by virtue of the raster scan nature of the scan a fixed time (which is itself short compared with the prior art) may be defined during which the target will be located. Previously acquisitioned time was dependent upon target position within the scanned frame.

Figure 2:
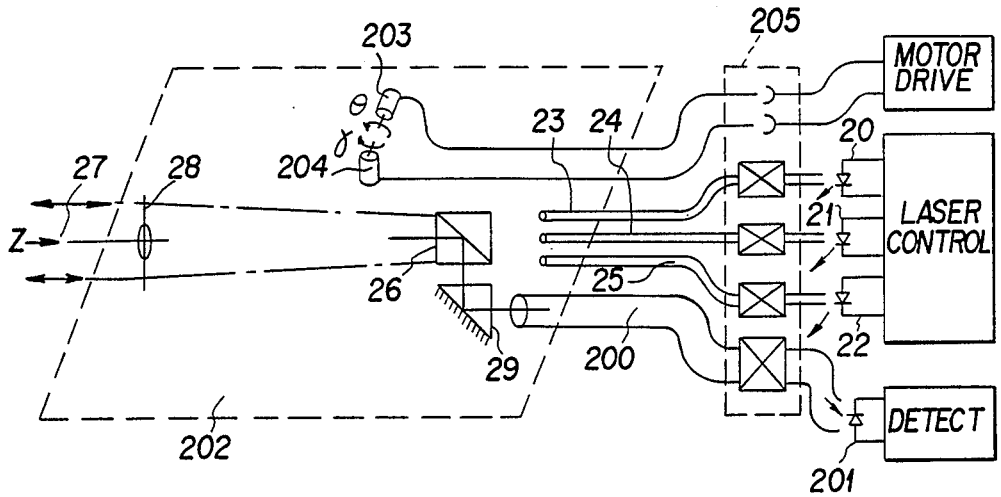
FIG. 2 represents a weapons simulator in accordance with the present invention.
Figure 3:
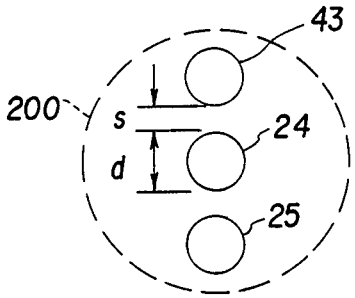
FIG. 3 represents fibre optical relationship.

An important advantage of the present invention is that there is no requirement for accurate optical positioning of the lasers, which may be at any convenient position and detachable for example by a single electro-optical connector 205 (FIG. 2). Thus maintenance servicing and improvement to the lasers and controllers may be performed without disturbing accurately positioned components. It will also be noted that no high energy supply to the movable table is required. Further benefits accrue during alignment of the fibres during assembly since potentially dangerous laser light need not be used, but unconditionally safe visible light sources instead at position 20–22. A similar emitter may be used at detector position 201, which is a considerable improvement over prior art alignment, where sources could not be interechanged.

It will be appreciated that separation at connector 205 allows separate testing of the alignment of the optical fibres, and the optical output and signal processing assemblies. In addition to the important advantage that failed output sources and detectors may be replaced without disturbing optical alignment this arrangment permits unconditionally safe testing of alignment in the field by means of a safe light source test package, and a viewer with interfaces with optical element 28 (FIG. 1). Thus a check on alignment by viewing a single projected pattern (FIG. 3) before and after use may be performed to validate the results of an exercise. Field adjustments by unskilled personnel to bring the viewed pattern into alignment (FIG. 3) are also made possible.

I claim:

1. A weapon training simulator including:

source means for producing electromagnetic radiation, output means for forming said radiation into a directable beam, input means for receiving reflected radiation, and detector means for sensing received radiation intensity;

wherein the output means and the input means are fixed with respect to each other and are movable together with respect to the weapon, the movement being such as to permit a scan of a target area, and the source means and the detector means are fixed on the weapon; and further including flexible guidance means for conveying radiation from the source means to the output means and the input means to the detector, said flexible guidance means being arranged to accommodate said movement.

2. A weapons training simulator as claimed in claim 1 and wherein the flexible guidance is provided by fibre optics.

3. A weapons training simulator as claimed in claim 1 and including a plurality of sources and output fibres arranged to provide spaced apart beams.

4. A weapons training simulator as claimed in claim 3 and including a receptor fibre of larger optical diameter than the output fibres.

5. A weapons training simulator as claimed in claim 1 and including control means to provide control signals to output means movement acutators such that the scan is established by movement firstly in azimuth to establish a first scan line, then in elevation a distance less than one beam width, and thirdly in reverse azimuth to establish a second scan line.

6. A weapons training simulator as claimed in claim 1 and including means for computing a cumulative average of received radiation intensity.

7. A weapons training simulator as claimed in claim 5 and including means for computing a cumulative average of received radiation intensity due to each scan line to provide elevation in formation.

8. A weapons training simulator as claimed in claim 7 and including means for performing a further elevation scan to provide increased resolution.

9. A weapons training simulator as claimed in claim 1 and wherein the source means includes a laser.

10. A weapons training simulator as claimed in claim 1 and wherein the moveable parts and the fixed parts are separable at the coupling means.

11. A weapons training simulator as claimed in claim 10 and wherein the coupling means is adapted to receive radiation from alternative sources of eye-safe radiation to produce a display for alignment.

12. A weapons training simulator as claimed in claim 11 and wherein the input means also received eye safe radiation to act as an output means.

* * * * *